US005457898A

United States Patent [19]

Fortin et al.

[11] Patent Number: 5,457,898

[45] Date of Patent: Oct. 17, 1995

[54] METATARSAL GUARD FOR SAFETY SHOE

[76] Inventors: Gilles Fortin, 1113, Chemin Principal; Sylvain Roy, 153 Chemin Boulet, both of Lac Drolet, Québec, Canada, G0Y 1C0; Christian Major, 5385, Waverly, Montréal, Québec, Canada, H2T 2X8

[21] Appl. No.: 218,251

[22] Filed: Mar. 25, 1994

[51] Int. Cl.[6] ..... A43C 13/14

[52] U.S. Cl. ..... 36/72 R; 36/77 R

[58] Field of Search ..... 36/72 R, 77 R, 36/77 M, 96

[56] References Cited

U.S. PATENT DOCUMENTS

| | | | |
|---|---|---|---|
| 564,966 | 8/1896 | Brewer | 36/77 R |
| 2,023,580 | 12/1935 | Fullarton | 36/72 R |
| 2,091,223 | 8/1937 | Binder | 36/72 R |
| 2,111,536 | 3/1938 | Murray | 36/72 R |
| 2,392,867 | 1/1946 | Stoner et al. | 36/72 R |
| 2,393,810 | 1/1946 | Purinton | 36/72 R |
| 2,615,261 | 10/1952 | Grotto | 36/72 R |
| 2,972,824 | 2/1961 | Schlecht | 36/72 R |
| 3,126,651 | 3/1964 | Bown et al. | 36/72 R |
| 3,841,004 | 10/1974 | Gray et al. | 36/72 R |
| 3,995,382 | 12/1976 | Smith | 36/72 R |
| 4,231,170 | 11/1980 | Griswold | 36/72 |
| 4,342,159 | 8/1982 | Edwards | 36/77 |
| 4,366,629 | 1/1983 | Scherz | 36/4 |
| 4,551,876 | 11/1985 | Leslie | 36/72 R X |
| 4,597,199 | 7/1986 | Hong | 36/77 R X |
| 4,735,003 | 4/1988 | Dykeman | 36/77 |
| 4,908,963 | 3/1990 | Krajar et al. | 36/72 R X |
| 4,991,318 | 2/1991 | Cornell | 36/72 R |

FOREIGN PATENT DOCUMENTS

| | | | |
|---|---|---|---|
| 1113712 | 12/1981 | Canada . | |
| 1131905 | 9/1982 | Canada . | |
| 1195494 | 10/1985 | Canada . | |
| 1239535 | 7/1988 | Canada . | |
| 1277136 | 12/1990 | Canada . | |
| 0095061 | 11/1983 | European Pat. Off. | 36/77 R |
| 0197805 | 5/1978 | Netherlands | 36/77 R |
| 0445807 | 4/1936 | United Kingdom | 36/77 R |
| 2127275 | 4/1984 | United Kingdom . | |

*Primary Examiner*—Paul T. Sewell
*Assistant Examiner*—Ted Kavanaugh

[57] ABSTRACT

A metatarsal guard inserted in the upper of a safety shoe is made of plastic and defines an arch extending from the sole of the shoe on one side of the wearer's instep to the sole on the other side of the wearer's instep. The metatarsal guard includes a rear impact-absorbing portion having longitudinal slits cut in the sheet material to form a transversal series of longitudinal tongues that spread apart to follow the movement of the foot when the wearer is walking. An integral flap is formed in the sheet material at the distal end of the central tongue. This central tongue is folded to apply the flap to the top surface of the tongues and thereby distribute the load upon the impact of a falling object. The metatarsal guard is further provided with two lateral slits cut in the sheet material and extending transversely to facilitate flexion of the metatarsal guard upon flexion of the wearer's foot. A front portion of the metatarsal guard includes at least one longitudinally extending tongue bent to be applied to the top surface of the toe cap whereby load applied to the metatarsal guard is also applied to the toe cap.

14 Claims, 2 Drawing Sheets

METATARSAL GUARD FOR SAFETY SHOE

BACKGROUND OF THE INVENTION

1. Field of the invention

The present invention relates to a metatarsal guard to be inserted in the upper of a safety shoe in order to protect the instep (metatarsal region) of the wearer's foot from injury caused by the impact of a falling object.

2. Brief description of the prior art

U.S. Pat. No. 4,908,963 granted to Krajcir et al. on Mar. 20, 1990 describes a metatarsal guard made of plastic material and forming an arch extending from the sole of a safety shoe on one side of the wearer's instep to the sole of that shoe on the other side of the instep whereby the arch is supported by the shoe's sole. The metatarsal guard comprises a series of transversal ribs and is made flexible by joining these transversal ribs through thinner webs to thereby enable articulation of the ribs and prevent the metatarsal guard to impede movement of the wearer's foot.

As can be appreciated by one of ordinary skill in the art, fabrication of the metatarsal guard of U.S. Pat. No. 4,908,963 requires complex and costly molding techniques. Also, the thinner webs of the metatarsal guard are susceptible, with time, to break to thereby reduce the performance of the metatarsal guard.

OBJECTS OF THE INVENTION

An object of the present invention is therefore to eliminate the above discussed drawbacks of the prior art by providing a metatarsal guard that can be made from a sheet of plastic material cut and thermoformed on a template.

Another object of the present invention is to provide a metatarsal guard which maximizes both protection of the instep (metatarsal region) of the wearer's foot and the wearer's comfort upon walking and crouching.

SUMMARY OF THE INVENTION

More specifically, in accordance with the present invention, there is provided a metatarsal guard to be inserted in the upper of a safety shoe, this metatarsal guard forming an arch extending from the sole of the safety shoe on one side of the instep of the wearer's foot to the sole on the other side of the wearer's instep. The metatarsal guard further comprises a rear impact-absorbing portion that is extensible transversely of the wearer's foot to prevent the metatarsal guard to impede movement of the foot when the wearer is walking.

In accordance with a preferred embodiment of the invention, the metatarsal guard is made of at least slightly flexible sheet material, and the rear impact-absorbing portion comprises longitudinal slits forming in the sheet material a transversal series of longitudinal tongues capable of spreading apart from each other to follow the movement of the foot when the wearer is walking. A flap integral with the sheet material of the metatarsal guard is formed at the distal end of one tongue and is folded on the top surface of the longitudinal tongues to distribute the load on these tongues.

In accordance with another preferred embodiment of the invention, the metatarsal guard comprises two lateral edge surfaces applied to the top surface of the sole of the safety shoe, and two slits cut in the sheet material and extending transversely of the wearer's foot from the two lateral edge surfaces, respectively, to facilitate flexion of the metatarsal guard and prevent this guard from impeding flexion of the foot of the wearer in a crouching posture.

In accordance with a further preferred embodiment, the safety shoe comprises a toe cap with a top surface and the metatarsal guard is formed with a front portion formed with at least one longitudinally extending tongue made in the sheet material and bent to be applied to the top surface of the toe cap whereby load applied to the metatarsal guard is also applied to the toe cap.

Preferably, the sheet material comprise high density polyethylene or high density polypropylene. It can therefore be easily cut and thermoformed into the metatarsal guard.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
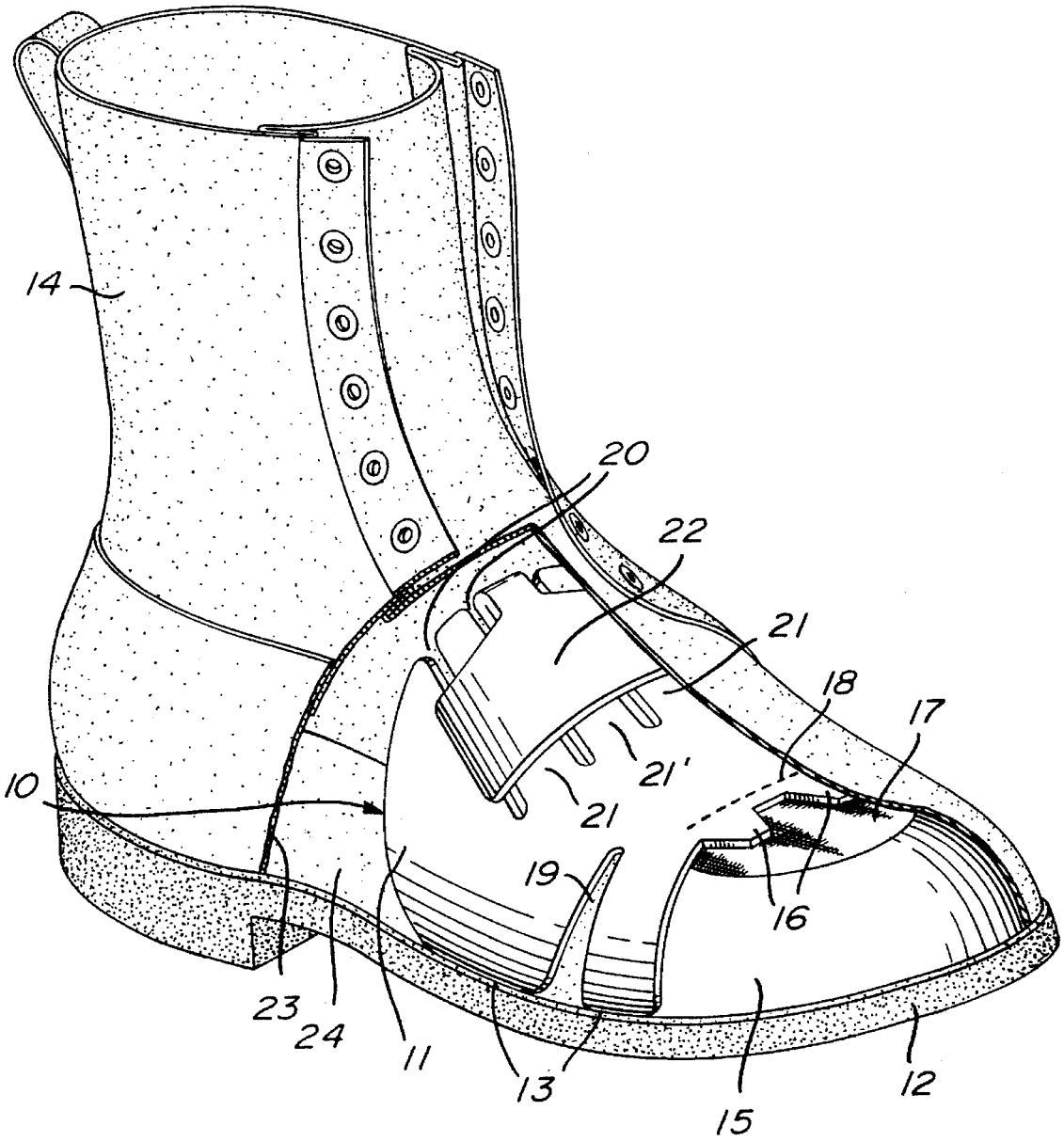
FIG. 1 is a perspective, partially cross sectional view of a right safety boot comprising a metatarsal guard in accordance with the present invention.
Figure 2:
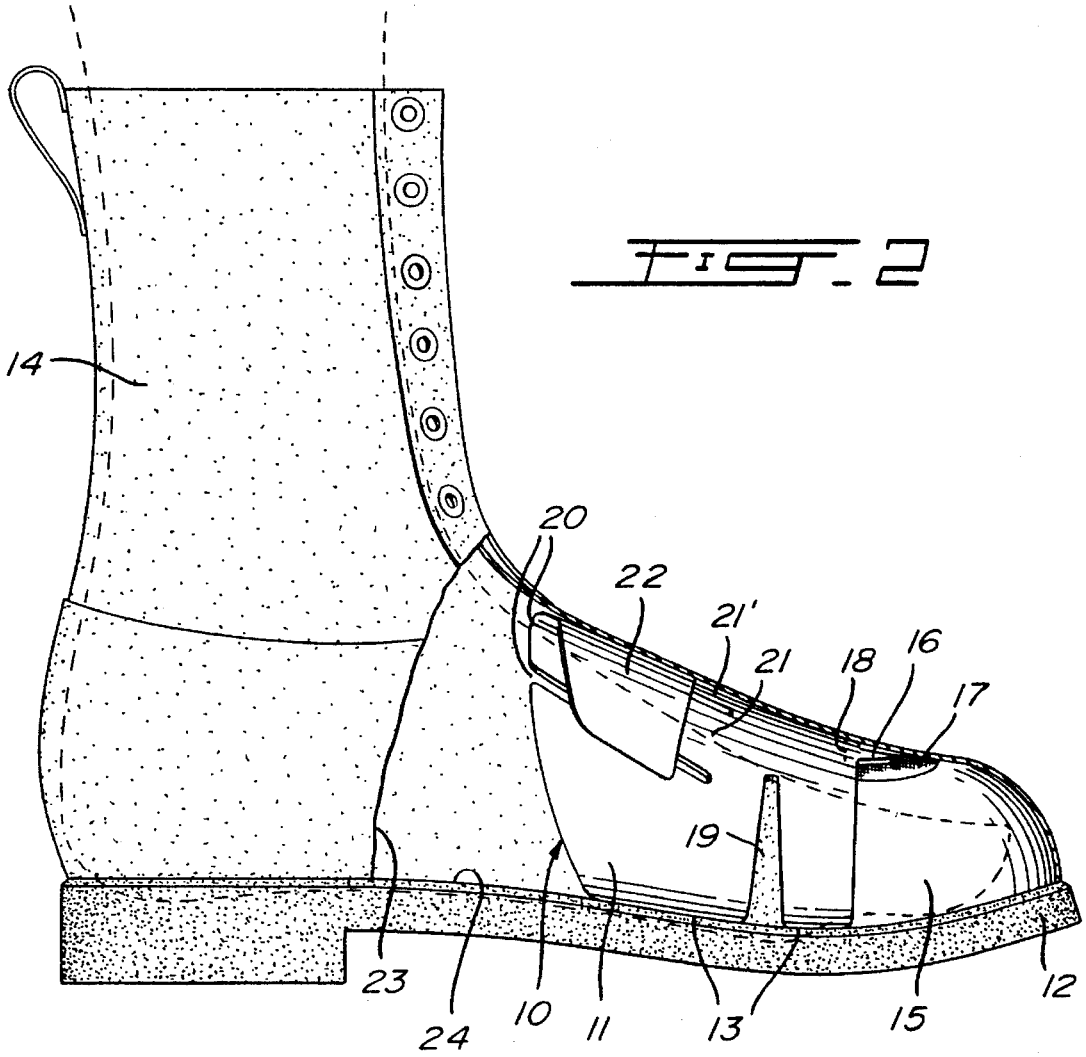
FIG. 2 is a right side, partially cross sectional elevational view of the boot and metatarsal guard of FIG. 1.

In FIGS. 1 and 2 of the appended drawings, the metatarsal guard in accordance with the present invention is generally identified by the reference 10.

Although FIGS. 1 and 2 illustrate only a right metatarsal guard 10 according to the invention, it should be kept in mind that the left metatarsal guard is identical but symmetrical to the right guard 10.

The metatarsal guard 10 is advantageously made of a sheet 11 of robust, slightly flexible plastic material. Although other plastic materials can be contemplated, the plastic sheet 11 is preferably made of high density polyethylene or high density polypropylene. The plastic sheet 11 can therefore be die cut, laser cut or water cut, and then thermoformed on a template to obtain the metatarsal guard 10. Of course, it is within the scope of the present invention to use other molding techniques.

The sheet 11 of plastic material is arched to follow the natural shape of the top of the foot's instep (metatarsal region) and extends rearwardly from the toes to cover the wearer's instep. The arched plastic sheet 11 comprises a right lateral edge surface 13 and a left lateral edge surface (not shown) both resting on the top surface of the sole 12 of a safety boot 14. The metatarsal guard 10 therefore defines an arch extending from the sole 12 on the right side of the foot's instep to the sole 12 on the left side of the foot's instep whereby it is supported by the sole 12 to prevent falling objects from striking and injuring the wearer's foot.

As well known to those of ordinary skill in the art, the safety boot 14 comprises a toe cap 15 made of steel in order to protect the wearer's toes against falling objects. The metatarsal guard 10 comprises a front portion provided with a transversal series of forwardly extending trapezoidal tongues 16 cut in the sheet 11. It is however within the scope of the present invention to replace the transversal series of forwardly extending tongues 16 by a single tongue (not shown). As illustrated, the tongues 16 are bent to be applied to the top surface of the toe cap 15 and to form a smooth transition curve between the front portion of the metatarsal guard 10 and the top surface of the toe cap 15.

The front portion of the metatarsal guard 10 is fixed to the toe cap 15 through a piece of fabric 17 (a) sewed or glued to the underside of the plastic sheet 11 in region 18 and (b) glued to the top surface of the steel cap 15.

Accordingly, when an object falls on the metatarsal guard 10, the load is not only applied to the sole 12 to which the lateral edge surfaces such as 13 are applied but is also applied to the steel toe cap 15 to the top surface of which the tongues 16 are applied, to thereby reduce the portion of the load distributed on the whole instep of the wearer's foot.

To facilitate flexion of the metatarsal guard 10 and prevent that guard to impede flexion of the foot of the wearer in a crouching posture, a relatively long right side slit 19 is cut in the plastic sheet 11 to extend from the lateral edge surface 13 toward the left side of the boot 14. A similar slit (not shown) is also provided on the left side of the metatarsal guard 10.

A transversal series of relatively long and generally longitudinal slits 20 are also cut in the plastic sheet 11 in the rear portion of the metatarsal guard 10. A transversal series of laterally adjacent and generally longitudinal tongues 21 is thereby formed. As can be appreciated by one of ordinary skill in the art, the laterally adjacent tongues 21 will spread apart from each other to follow the movement of the foot when the wearer is walking and thereby prevent the metatarsal guard 10 from impeding walking.

To distribute the load on the different tongues 21 upon the impact of a falling object with the metatarsal guard 10, a flap 22 is cut in the plastic sheet 11 and applied to the top surface of the laterally adjacent longitudinal tongues 21. More specifically, the flap 22 is integral with and constitutes an extension of the central longitudinal tongue 21' which is folded at it distal end to apply the flap 22 to the top surface of the tongues 21. Flap 22 therefore compensates for the weakness of the rear portion of the metatarsal guard 10 created by the longitudinal slits 20 cut in the plastic sheet 11. The flap 22 will also enable the tongues 21 to move freely and follow the movement of the wearer's instep upon walking.

Therefore, the rear portion of the metatarsal guard 10 constitutes a rear impact-absorbing portion that is extensible transversely of the wearer's foot to prevent the metatarsal guard 10 to impede movement of the foot when the wearer is walking.

As can be appreciated by one of ordinary skill in the art, the metatarsal guard 10 is inserted into the upper of the safety boot 14 between an outer layer 23 of leather or other suitable material such as leather-like man-made materials, and an inner liner 24 which can be made of a similar leather-like material. Preferably, the metatarsal guard 10 will also be placed into a cushioned envelope (not shown) secured to the toe cap 15 and inserted between the outer layer 23 and the inner liner 24.

Finally, it should be pointed out that the metatarsal guard 10 according to the invention has been designed in view of maximizing both the protection of the instep of the wearer's foot and the wearer's comfort even in a crouching posture.

Although the present invention has been described hereinabove by way of a preferred embodiment thereof, this embodiment can be modified at will, within the scope of the appended claims, without departing from the spirit and nature of the subject invention.

What is claimed is:

1. A metatarsal guard comprising:

a first piece of at least slightly flexible sheet material arched to cover a wearer's instep, said first piece comprising an impact-absorbing portion having a plurality of laterally spaced apart and generally coextending slits forming in said at least slightly flexible sheet material a plurality of laterally adjacent tongues to make said impact-absorbing portion extensible transversely of the slits and thereby prevent the metatarsal guard to impede movement of a wearer's foot; and a second unitary load-distributing piece of sheet material attached to one of said tongues and covering a top surface of all of said tongues to distribute a load on said tongues upon an impact between an object and the metatarsal guard.

2. The metatarsal guard of claim 1, wherein said impact-absorbing portion is a rear impact-absorbing portion, said laterally spaced apart and generally coextending slits are substantially longitudinal slits, and said plurality of laterally adjacent tongues is a transversal series of substantially longitudinal tongues capable of spreading apart from each other to follow the movement of the foot when the wearer is walking.

3. The metatarsal guard of claim 1, wherein said second piece of sheet material is a flap integral with said first piece of at least slightly flexible sheet material of the metatarsal guard.

4. The metatarsal guard of claims 3, in which one of said tongues comprises a distal end, and in which said flap is an extension of the distal end of said one tongue, said one tongue being folded at said distal end to apply said flap to the top surface of said tongues.

5. The metatarsal guard of claim 1, in which said metatarsal guard is made of plastic sheet material cut and thermoformed into said metatarsal guard.

6. The metatarsal guard of claim 5, wherein said plastic sheet material comprises high density polyethylene.

7. The metatarsal guard of claim 5, wherein said plastic sheet material comprises high density polypropylene.

8. A safety shoe comprising a sole, an upper peripherally mounted to the sole, and a metatarsal guard inserted in the upper, said metatarsal guard comprising:

a first piece of at least slightly flexible sheet material arched to extend from the sole on one side of the instep of a wearer's foot to the sole on the other side of the wearer's instep, said first piece comprising an impact-absorbing portion having a plurality of laterally spaced apart and generally coextending slits forming in said at least slightly flexible sheet material a plurality of laterally adjacent tongues to make said impact-absorbing portion extensible transversely of the slits to thereby prevent the metatarsal guard to impede movement of the wearer's foot; and a second unitary load-distributing piece of sheet material attached to one of said tongues and covering a top surface of all of said tongues to distribute a load on said tongues upon an impact between an object and the metatarsal guard.

9. A safety shoe as recited in claim 8, wherein said impact-absorbing portion is a rear impact-absorbing portion, said slits are substantially longitudinal slits, and said plurality of laterally adjacent tongues is a transversal series of substantially longitudinal tongues capable of spreading apart from each other to follow the movement of the foot when the wearer is walking.

10. A safety shoe as recited in claim 9, wherein said second piece of sheet material is a flap integral with said first piece of at least slightly flexible sheet material, one of said longitudinal tongues comprises a distal end, and said flap is an extension of the distal end of said one longitudinal tongue, said one longitudinal tongue being folded at said distal end to apply said flap to the top surface of said tongues.

11. A safety shoe as recited in claim 8, wherein said second piece of sheet material is a flap integral with said first piece of at least slightly flexible sheet material.

12. A safety shoe as recited in claim 8, wherein said safety shoe comprises a toe cap with a top surface, and wherein said first piece of at least slightly flexible sheet material comprises a front portion formed with at least one generally longitudinally extending tongue bent to be applied to the top surface of the toe cap.

13. A safety shoe as recited in claim 12, in which said at least one generally longitudinally extending tongue comprises a transversal series of generally longitudinally extending tongues made in said at least slightly flexible sheet material of said first piece and bent to be applied to the top surface of the toe cap.

14. A safety shoe as recited in claim 13, wherein the front portion of said first piece is connected to the toe cap through a piece of fabric.

* * * * *